US012419431B2

(12) United States Patent
Chen

(10) Patent No.: US 12,419,431 B2
(45) Date of Patent: Sep. 23, 2025

(54) BED FRAME INSTALLATION STRUCTURE AND BED FRAME STRUCTURE

(71) Applicant: House & Home Co., Ltd., Fujian (CN)

(72) Inventor: Xusheng Chen, Fujian (CN)

(73) Assignee: House & Home Co., Ltd., Fujian (CN)

( * ) Notice: Subject to any disclaimer, the term of this patent is extended or adjusted under 35 U.S.C. 154(b) by 170 days.

(21) Appl. No.: 18/377,832

(22) Filed: Oct. 9, 2023

(65) Prior Publication Data

US 2024/0032701 A1 Feb. 1, 2024

(51) Int. Cl.

| | |
|---|---|
| ***A47C 19/20*** | (2006.01) |
| ***A47C 19/00*** | (2006.01) |
| ***A47C 19/02*** | (2006.01) |

(52) U.S. Cl.

CPC ..... *A47C 19/20* (2013.01); *A47C 19/005* (2013.01); *A47C 19/022* (2013.01)

(58) Field of Classification Search

CPC ..... A47C 19/20; A47C 19/005; A47C 19/022; A47C 19/021; F16B 12/56; F16B 12/2054; F16B 12/20; F16B 12/22

See application file for complete search history.

(56) References Cited

U.S. PATENT DOCUMENTS

| | | | | |
|---|---|---|---|---|
| 4,127,353 | A * | 11/1978 | Busse | F16B 12/2054 403/245 |
| 2016/0153484 | A1* | 6/2016 | Bilis | F16B 12/56 29/469 |
| 2023/0397739 | A1* | 12/2023 | Leng | F16B 12/60 |
| 2024/0324785 | A1* | 10/2024 | Chen | A47C 19/005 |

FOREIGN PATENT DOCUMENTS

| | | | | |
|---|---|---|---|---|
| CN | 203987065 U | * | 12/2014 | A47C 19/20 |
| KR | 102584465 B1 | * | 10/2023 | A47C 19/005 |
| WO | WO-2018018980 A1 | * | 2/2018 | A47C 19/005 |

* cited by examiner

*Primary Examiner* — Matthew Troutman
*Assistant Examiner* — Alison N Labarge
(74) *Attorney, Agent, or Firm* — Birchwood IP

(57) ABSTRACT

A bed frame installation structure, having two bed posts spaced apart from each other and a bed support rod; a bottom of each end of the bed support rod is bent and warped into a hook piece, and a top side of which is formed with a locking plate; a locking hole and a hook hole are formed on each bed post corresponding to a corresponding end of the bed support rod; the hook piece is accommodated in a corresponding bed post to engage with a lower edge of the hook hole, and the locking plate is fixed to the locking hole by a screw. A bed frame structure is also disclosed having a bed surface frame and two bed frame installation structures spaced apart from each other; a bed side beam is provided between two corresponding bed posts of the two sets of the bed frame installation structure.

5 Claims, 4 Drawing Sheets

BED FRAME INSTALLATION STRUCTURE AND BED FRAME STRUCTURE

TECHNICAL FIELD

The present invention relates to the technical field of beds, and in particular to a bed frame installation structure and a bed frame structure.

BACKGROUND OF THE INVENTION

In order to reduce the volume during transportation, existing bed frames are usually disassembled into a bed surface frame, multiple bed posts, and multiple bed support rods during transportation. A bed support rod is fixed between two bed posts, and ends of each of the bed support rods are provided with an upper locking piece and a lower locking piece respectively. The upper locking piece and the lower locking piece of each support rod are fixed to adjacent bed posts through screws, resulting in inconvenience of installation.

BRIEF SUMMARY OF THE INVENTION

It is an object of the present invention is to provide a bed frame installation structure that is easy to assemble.

It is another object of the present invention is to provide a bed frame structure that utilizes the bed frame installation structure of the present invention.

To achieve the above objects, the present invention employs the following technical solutions.

A bed frame installation structure, comprising two bed posts arranged spaced apart from each other, and a bed support rod; a bottom side of each of two ends of the bed support rod is bent and warped to form a hook piece, and a top side of each of the two ends of the bed support rod is formed with a locking plate; a locking hole and a hook hole are formed on each of the bed posts at a position corresponding to a corresponding end of the bed support rod; the hook piece of each of the two ends of the bed support rod is accommodated in a corresponding bed post in way that the hook piece is engaged with a lower edge of the hook hole of the corresponding bed post, and the locking plate of each of the two ends of the bed support rod is fixed to the locking hole of the corresponding bed post by a screw.

A bed frame structure, comprising a bed surface frame and two sets of the bed frame installation structure; the two sets of the bed frame installation structure are arranged spaced apart from each other; a bed side beam is installed between each bed post of one set of the bed frame installation structure and a corresponding aligned bed post of another set of the bed frame installation structure; a surface of each bed post of one set of the bed frame installation structure facing towards the corresponding aligned bed post of another set of the bed frame installation structure, and vice versa, are in each case provided with a bracket and a limiting column arranged spaced apart from the bracket and positioned below the bracket; at least one upper locking member and at least one lower locking member are arranged on the bracket; the bracket is accommodated into a corresponding end of a corresponding bed side beam; each end of each bed side beam is provided with an upper locking pin and a lower locking pin penetrating therethrough; the limiting column abuts against a bottom surface of the corresponding end of the corresponding bed side beam; the upper locking pin passes through the upper locking member, and the lower locking pin passes through the lower locking member; the bed surface frame is fixed between two bed side beams and two bed support rods.

Said at least one upper locking member arranged on the bracket comprises two parallel upper locking members arranged spaced apart from each other; and said at least one lower locking member arranged on the bracket comprises two parallel lower locking members arranged spaced apart from each other.

The bed surface frame comprises a plurality of bed support bars arranged spaced apart from one another, and at least one fixing connector; the fixing connector is a strip that fixes and connects the bed support bars; two ends of each of the bed support bars are fixed at the two bed side beams positioned in a same horizontal plane.

Upper guardrails are fixed between upper portions of all the bed posts of the two sets of the bed frame installation structure to surround the bed, wherein one upper guardrail of the upper guardrails is arranged above each of the bed side beams and above each of the bed support rods; an upper bed surface frame is fixed between bottom sides of the upper guardrails.

A middle portion of one of the upper guardrails is recessed to form an opening, and a ladder is fixed between a bottom of the opening and a corresponding bed support rod below the opening.

The bed frame installation structure according to the present invention enables a quick positioning and installation of the bed posts and the bed support rod by forming locking holes and hook holes on the bed posts, in conjunction with hook pieces formed by bending and warping the bottom sides of two ends of the bed support rod and the locking plates formed on the top sides of the two ends of the bed support rod, thereby enabling the hook pieces to hook onto the lower edges of the hook holes. Additionally, by threading screws through the locking plates and locking holes, the bed posts and bed support rod are fixed together, eliminating the need for two separate screw-locking actions and making the overall installation convenient.

DESCRIPTION OF REFERENCE NUMERALS

Figure 1:
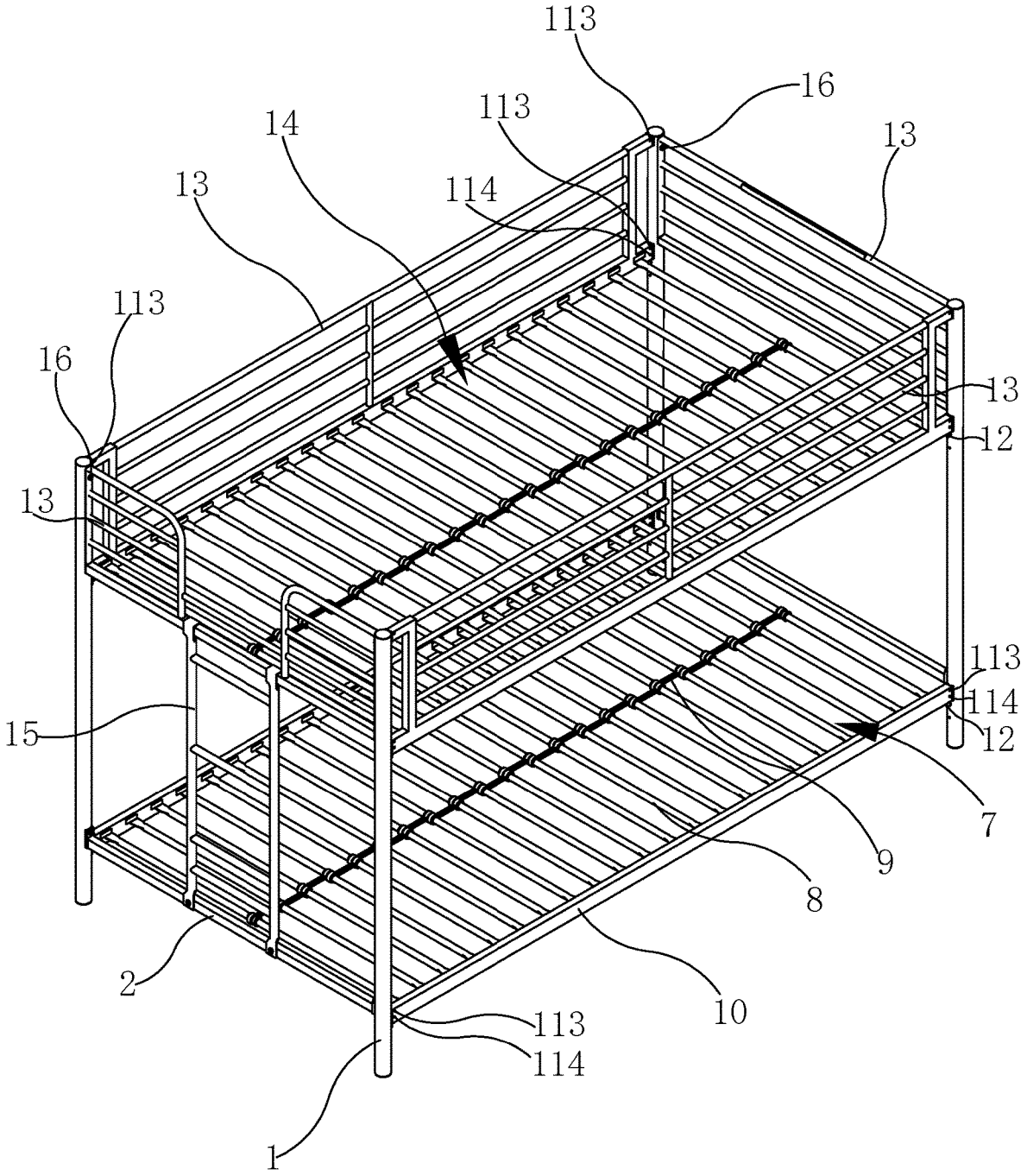
FIG. 1 is a perspective view of the bed frame structure according to the present invention.

| | |
|---|---|
| Bed post 1 | Bed support rod 2 |
| Hook piece 3 | Locking plate 4 |
| Locking hole 5 | Hook hole 6 |
| Bed surface frame 7 | |
| Bed support bar 8 | Fixing connector 9 |
| Bed side beam 10 | |
| Bracket 11 | |
| Upper locking member 111 | Lower locking member 112 |
| Upper locking pin 113 | Lower locking pin 114 |

-continued

| | |
|---|---|
| Limiting column 12 | |
| Upper guardrail 13 | |
| Opening 131 | |
| Upper bed surface frame 14 | Ladder 15 |
| Screw 16. | |

DETAILED DESCRIPTION OF THE INVENTION

Further details of the present invention are described below in conjunction with the accompanying drawings and specific embodiments.

Referring to FIGS. 1 to 7, the present invention discloses a bed frame installation structure, which comprises two bed posts 1 arranged spaced apart from each other, and a bed support rod 2. A bottom side of each of two ends of the bed support rod 2 is bent and warped to form a hook piece 3, and a top side of each of the two ends of the bed support rod 2 is formed with a locking plate 4. A locking hole and a hook hole 6 are formed on each of the bed posts at a position corresponding to a corresponding end of the bed support rod 2. The hook piece 3 of each of the two ends of the bed support rod 2 is accommodated in a corresponding bed post 1 in way that the hook piece 3 is engaged with a lower edge of the hook hole 6 of the corresponding bed post 1, and the locking plate 4 of each of the two ends of the bed support rod 2 is fixed to the locking hole 5 of the corresponding bed post 1 by a screw 16.

Figure 2:
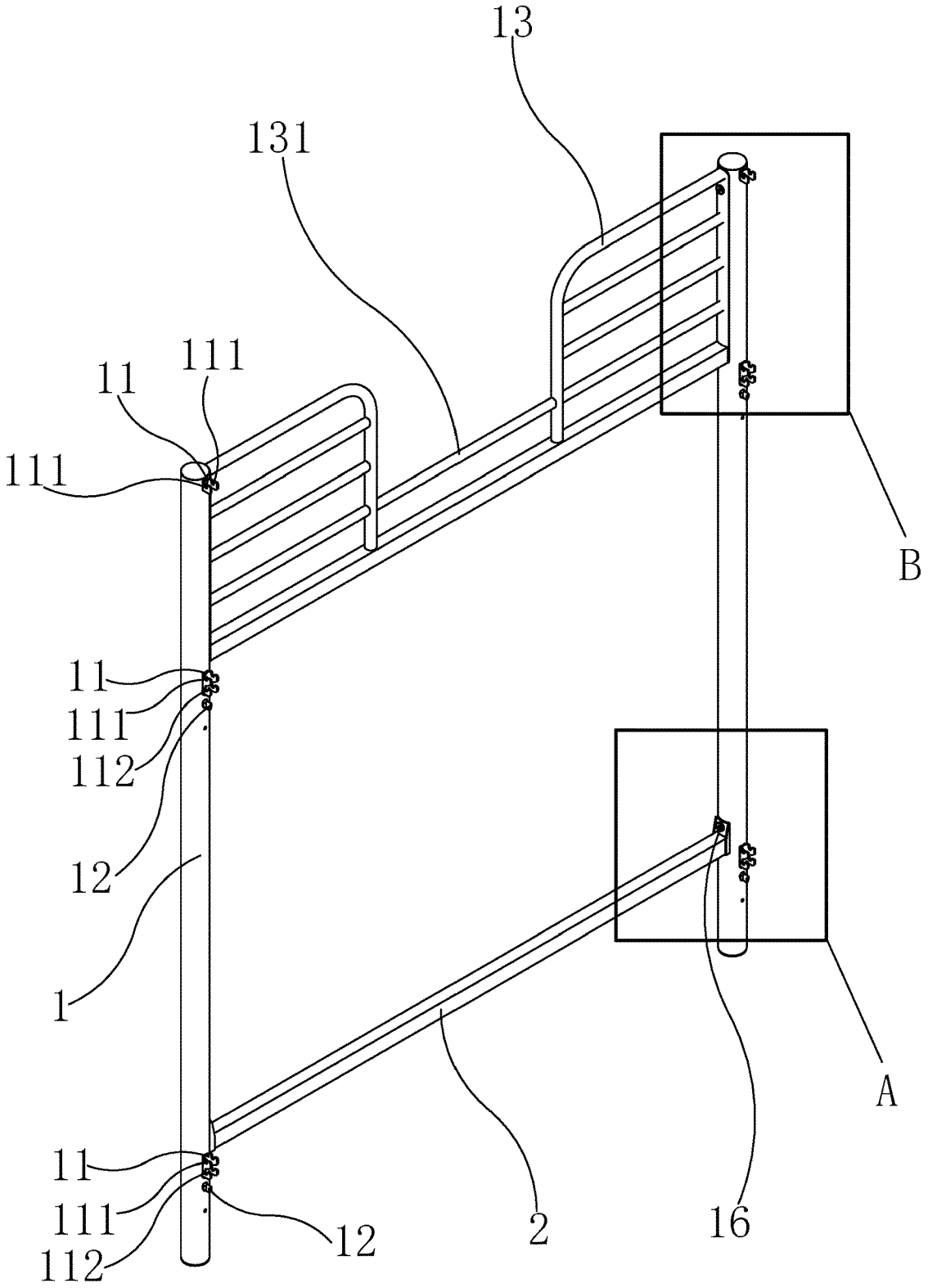
FIG. 2 is a partial perspective view of FIG. 1.
Figure 3:
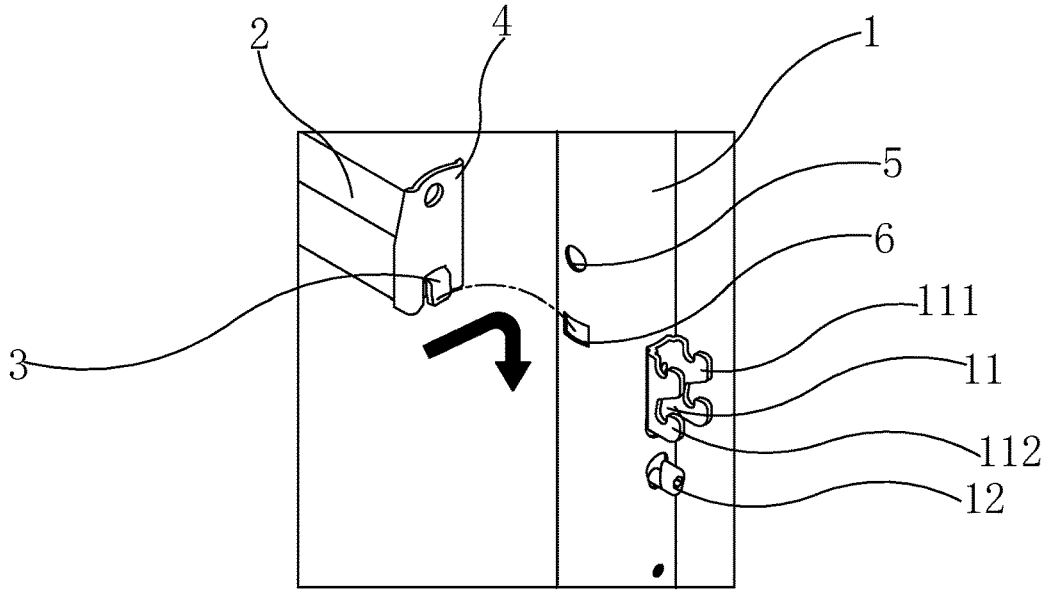
FIG. 3 is an assembly schematic diagram (1) at portion A of FIG. 2.
Figure 4:
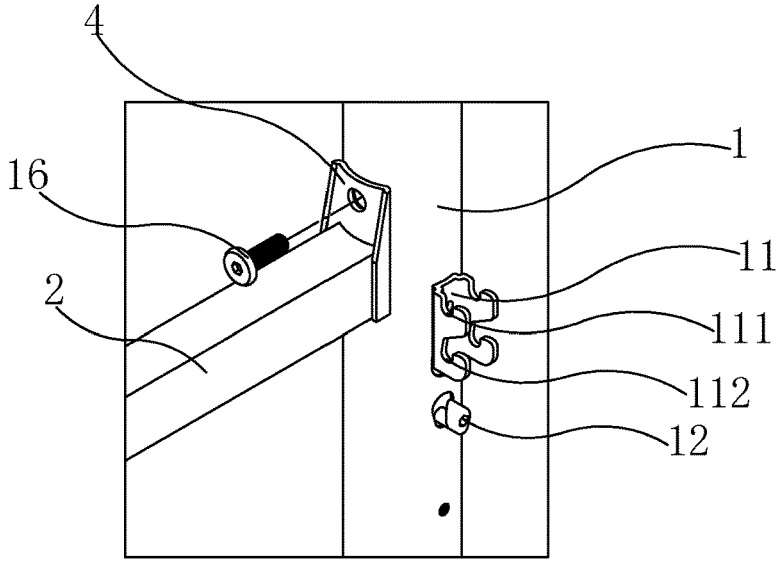
FIG. 4 is an assembly schematic diagram (2) at portion A of FIG. 2.
Figure 5:
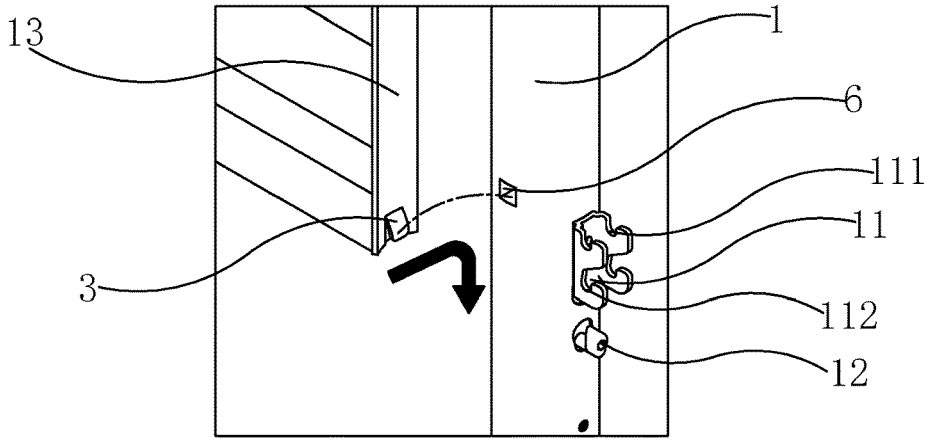
FIG. 5 is an assembly schematic diagram (1) at portion B of FIG. 2.
Figure 6:
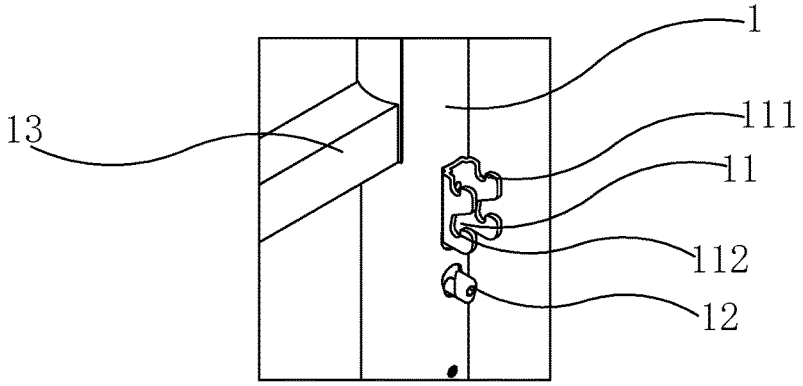
FIG. 6 is an assembly schematic diagram (2) at portion B of FIG. 2.
Figure 7:
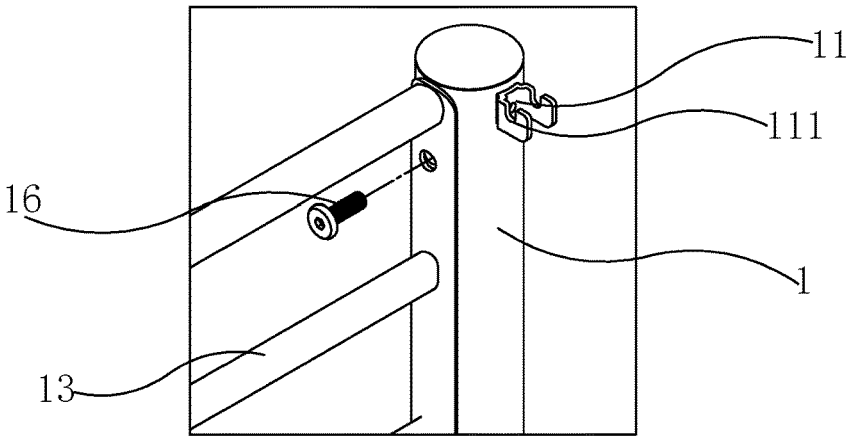
FIG. 7 is an assembly schematic diagram (3) at portion B of FIG. 2.

Referring to FIGS. 1 and 2, the present invention further discloses a bed frame structure, which comprises a bed surface frame 7 and two sets of the aforementioned bed frame installation structure. The two sets of the bed frame installation structure are arranged spaced apart from each other; a bed side beam 10 is installed between each bed post 1 of one set of the bed frame installation structure and a corresponding aligned bed post 1 of another set of the bed frame installation structure. A surface of each bed post 1 of one set of the bed frame installation structure facing towards the corresponding aligned bed post 1 of another set of the bed frame installation structure, and vice versa, are in each case provided with a bracket 11 and a limiting column 12 arranged spaced apart from the bracket 11 and positioned below the bracket 11. At least one upper locking member 111 and at least one lower locking member 112 are arranged on the bracket 11. The bracket 11 is accommodated into a corresponding end of a corresponding bed side beam 10. Each end of each bed side beam 10 is provided with an upper locking pin 113 and a lower locking pin 114 penetrating therethrough. The limiting column 12 abuts against a bottom surface of the corresponding end of the corresponding bed side beam 10. The limiting column 12 limit the corresponding bed side beam 10 from being accidentally removed. The upper locking pin 113 passes through the upper locking member 111, and the lower locking pin 114 passes through the lower locking member 112. The bed surface frame 7 is fixed between two bed side beams 10 and two bed support rods 2. As shown in the figures, two parallel upper locking members 111 arranged spaced apart from each other and two parallel lower locking members 112 arranged spaced apart from each other are arranged on each bracket 11.

Further, to simplify the structure, the bed surface frame 7 comprises a plurality of bed support bars 8 arranged spaced apart from one another, and at least one fixing connector 9. The fixing connector 9 is a strip that fixes and connects the bed support bars 8; two ends of each of the bed support bars 8 are fixed at the two bed side beams 10 positioned in a same horizontal plane. In this embodiment, the fixing connector 9 is embodied as a single strip that fixes and connects middle portions of the bed support bars 8.

Moreover, to form a bunk bed, upper guardrails 13 are fixed between upper portions of all the bed posts 1 of the two sets of the bed frame installation structure to surround the bed. In other words, one upper guardrail 13 is arranged above each of the bed side beams 10 and above each of the bed support rods 2, and the upper guardrails 13 are vertically spaced apart from the bed side beams 10 and the bed support rods 2. An upper bed surface frame 14 is fixed between bottom sides of the upper guardrails 13. The upper bed surface frame 14 has a same structure as the bed surface frame 7 in that the upper bed surface frame 14 also comprises a plurality of bed support bars 8 arranged spaced apart from one another, and at least one fixing connector 9, and the fixing connector 9 fixes and connects middle portions of the bed support bars 8 of the upper bed surface frame 14.

For the convenience of user to climb onto the upper bed surface frame 14, a middle portion of one of the upper guardrails 13 is recessed to form an opening 131, and a ladder 15 is fixed between a bottom of the opening 131 and the bed support rod 2 below the opening.

An upper end of the ladder 15 is fixed to the bottom of the opening 131 through screws 16, and a bottom end of the ladder 15 is fixed to the bed support rod 2 below the opening also through screws 16.

In addition, upper portions of two sides of two of the upper guardrails 13 at left and right sides of the bed (that is the upper guardrail corresponding to where the ladder 15 is provided, and another upper guardrail opposite to the upper guardrail that corresponds to where the ladder 15 is provided) are provided with screws 16 to fix the upper portions of the two sides of said two upper guardrails 13 to corresponding bed posts 1; also, a bottom end of each of the two sides of each of these said two upper guardrails 13 is bent and warped to form another hook piece 3, and another hook hole 6 is formed on the corresponding bed post 1 corresponding to said another hook piece 3; said another hook piece 3 is engaged with a lower edge of said another hook hole 6.

Furthermore, upper portions of two sides of another two of the upper guardrails 13 at front and rear sides of the bed are each also provided with another upper locking pin 113 penetrating therethrough. Another bracket 11 is arranged on each of the bed posts 1 corresponding to the upper portions of the two sides of said another two of the upper guardrails 13, and said another bracket 11 is accommodated into a corresponding upper portion of a corresponding side of a corresponding one of said another two upper guardrails 13. Another two parallel upper locking members 111 arranged spaced apart from each other are arranged on said another bracket 11, and said another upper locking pin 113 passes through corresponding said another upper locking members 111.

Further, lower portions of the two sides of said another two of the upper guardrails 13 at front and rear sides of the bed are each also provided with yet another upper locking pin 113 and another lower locking pin 114 penetrating therethrough. Yet another bracket 11 and another limiting column 112 spaced apart from yet another bracket 11 and positioned below said yet another bracket 11 are arranged on each of the bed posts 1 corresponding to the lower portions of the two sides of said another two of the upper guardrails 13; at least one yet another upper locking member 111 and at least one another lower locking member 112 are arranged on said yet another bracket 11. Said yet another bracket 11 is accommodated into a corresponding lower portion of a corresponding side of a corresponding one of said another two of the upper guardrails 13. Said another limiting column 12 abuts against a bottom surface of a corresponding one of said another two of the upper guardrails 13. Said another limiting column 12 limits the corresponding upper guardrail 13 from being accidentally removed. Said yet another upper locking pin 113 passes through a corresponding said yet another upper locking member 111, and the said another lower locking pin 114 passes through a corresponding said another lower locking member 112. As shown in the figures, two parallel said yet another upper locking members 111 arranged spaced apart from each other and two parallel said another lower locking members 112 arranged spaced apart from each other are arranged on each said yet another bracket 11.

In summary, the bed frame installation structure according to the present invention enables a quick positioning and installation of the bed posts 1 and the bed support rod 2 by forming locking holes 5 and hook holes 6 on the bed posts 1, in conjunction with hook pieces 3 formed by bending and warping the bottom sides of two ends of the bed support rod 2 and the locking plates 4 formed on the top sides of the two ends of the bed support rod 2, thereby enabling the hook pieces 3 to hook onto the lower edges of the hook holes 6. Additionally, by threading screws 16 through the locking plates 4 and locking holes 5, the bed posts 1 and bed support rod 2 are fixed together, eliminating the need for two separate screw-locking actions and making the overall installation convenient.

The above descriptions are merely preferred embodiments of the present invention and do not limit the technical scope of the invention in any way. Therefore, any changes or modifications made in accordance with the claims and specifications of the present invention shall fall within the scope of the patent coverage of the present invention.

What is claimed is:

1. A bed frame structure, comprising a bed surface frame and two sets of the bed frame installation structure each comprising the following structure:

two bed posts arranged spaced apart from each other, and a bed support rod; a bottom side of each of two ends of the bed support rod is bent and warped to form a hook piece, and a top side of each of the two ends of the bed support rod is formed with a locking plate; a locking hole and a hook hole are formed on each of the bed posts at a position corresponding to a corresponding end of the bed support rod; the hook piece of each of the two ends of the bed support rod is accommodated in a corresponding bed post in way that the hook piece is engaged with a lower edge of the hook hole of the corresponding bed post, and the locking plate of each of the two ends of the bed support rod is fixed to the locking hole of the corresponding bed post by a screw;

the two sets of the bed frame installation structure are arranged spaced apart from each other; a bed side beam is installed between each bed post of one set of the bed frame installation structure and a corresponding aligned bed post of another set of the bed frame installation structure; a surface of each bed post of one set of the bed frame installation structure facing towards the corresponding aligned bed post of another set of the bed frame installation structure, and vice versa, are in each case provided with a bracket and a limiting column arranged spaced apart from the bracket and positioned below the bracket; at least one upper locking member and at least one lower locking member are arranged on the bracket; the bracket is accommodated into a corresponding end of a corresponding bed side beam; the limiting column abuts against a bottom surface of the corresponding end of the corresponding bed side beam; the bed surface frame is fixed between two bed side beams and two bed support rods.

2. The bed frame structure of claim 1, wherein said at least one upper locking member arranged on the bracket comprises two parallel upper locking members arranged spaced apart from each other; and said at least one lower locking member arranged on the bracket comprises two parallel lower locking members arranged spaced apart from each other.

3. The bed frame structure of claim 1, wherein the bed surface frame comprises a plurality of bed support bars arranged spaced apart from one another, and at least one fixing connector; the fixing connector is a strip that fixes and connects the bed support bars; two ends of each of the bed support bars are fixed at the two bed side beams positioned in a same horizontal plane.

4. The bed frame structure of claim 3, wherein upper guardrails are fixed between upper portions of all the bed posts of the two sets of the bed frame installation structure to surround the bed, wherein one upper guardrail of the upper guardrails is arranged above each of the bed side beams and above each of the bed support rods; an upper bed surface frame is fixed between bottom sides of the upper guardrails.

5. The bed frame structure of claim 4, wherein a middle portion of one of the upper guardrails is recessed to form an opening, and a ladder is fixed between a bottom of the opening and a corresponding bed support rod below the opening.

* * * * *